US005400736A

United States Patent [19]

Gold

[11] Patent Number: 5,400,736

[45] Date of Patent: Mar. 28, 1995

[54] UNDERWATER SIGNALING DEVICE

[76] Inventor: Donald S. Gold, 6844 Talisman Cove, Memphis, Tenn. 38119

[21] Appl. No.: 622,654

[22] Filed: Dec. 5, 1990

[51] Int. Cl.[6] ..... B63B 45/08

[52] U.S. Cl. ..... 116/26; 367/141

[58] Field of Search ..... 116/26, 27; 43/42.31; 446/418, 419, 421; 367/141

[56] References Cited

U.S. PATENT DOCUMENTS

| | | | |
|---|---|---|---|
| D. 47,126 | 3/1915 | Whitehouse . | |
| D. 275,581 | 9/1984 | Nakao et al. | D21/65 |
| 954,544 | 4/1910 | Sanford . | |
| 1,299,403 | 4/1919 | Da Costa . | |
| 2,197,096 | 4/1940 | Cyr . | |
| 2,318,460 | 3/1942 | Brief . | |
| 2,644,890 | 7/1953 | Hollihan | 250/71 |
| 2,986,833 | 6/1961 | Harris et al. | 43/42.31 |
| 3,705,465 | 12/1972 | Charney | 43/42.31 |
| 3,802,115 | 4/1974 | Auten et al. | 43/42.31 |
| 3,906,884 | 9/1975 | Gould | 181/121 |
| 4,179,973 | 12/1979 | White | 84/402 |
| 4,183,008 | 1/1980 | Crist | 367/142 |
| 4,538,806 | 9/1985 | Wilkerson | 272/122 |
| 4,791,750 | 12/1988 | Gammill | 43/42.31 |
| 4,858,204 | 8/1989 | Holston et al. | 367/141 |
| 4,950,107 | 8/1990 | Hancock et al. | 405/186 |
| 4,968,283 | 11/1990 | Montgomery | 446/419 |
| 5,010,529 | 4/1991 | Maynus | 367/137 |
| 5,187,691 | 2/1993 | Oehme et al. | 367/134 |
| 5,199,820 | 4/1993 | Nicklo | 405/186 |

FOREIGN PATENT DOCUMENTS

| | | | |
|---|---|---|---|
| 2455553 | 1/1981 | France | 24/17 B |

*Primary Examiner*—William A. Cuchlinski, Jr.
*Assistant Examiner*—Willie Morris Worth
*Attorney, Agent, or Firm*—Howrey & Simon; Thomas J. Scott, Jr.

[57] ABSTRACT

A brightly colored underwater signaling device having a brightly colored watertight container filled with one or more freely-movable spherical objects. Vigorous displacement of the container causes the spheres to collide with and impact both each other and the inner wall of the container to produce an audible rattling sound with a pitch, timbre and intensity which is easily transmitted through water. The device is preferably constructed of PVC pipe containing a plurality of ball-bearings and connected to a skin diver's diving apparatus with a connecting strap.

20 Claims, 1 Drawing Sheet

UNDERWATER SIGNALING DEVICE

FIELD OF THE INVENTION

The field of the present invention is signaling devices for human skin divers.

BACKGROUND AND SUMMARY OF THE INVENTION

The present invention relates to underwater signaling devices for skin divers.

In the undersea environment, human skin divers often find it difficult, if not impossible, to verbally communicate. The breathing apparatus connected to scuba tanks, called the regulator, or a diver's snorkel mouthpiece must be used almost constantly whenever a diver is below the surface of the water. These devices create a great impediment to the diver's making voice sounds. In addition, the noises generated by the expulsion of bubbles into the water created by the exhalations of the diver tend to mask or overpower efforts at generating audible communication signals visual communication is also hindered at deeper depths because of low sunlight penetration.

The limited communication ability between divers can at times be life-threatening. For instance, divers are instructed never to dive alone because of the many hazards which may befall one. Equipment failures can interrupt the supply of oxygen necessary to support life. Bites from undersea animals, disorientation and debilitating physical ailments such as decompression sickness can completely incapacitate a diver and cause death. The danger from these types of situations are present even when diving in groups, if other parties diving nearby cannot be signaled. In many diving situations, communication of impending danger or actual debilitation is extremely difficult. Dim light combined with a lack of ability to audibly communicate the graveness of a situation may prevent even a buddy skin diver, who may be in close physical proximity, from responding in time to what might be a life-threatening medical emergency.

Thus, there exists a need in the art for an underwater signaling device which can be heard over the bubbling caused by a regulator or snorkel. The signaling device should produce an audible sound having a characteristic timbre, pitch and intensity which is distinguishable from other undersea sounds. The device also should be preferably brightly colored to enhance its visibility in the dim light of deep water.

The present invention facilitates signaling for communicating underwater. The present invention, in the preferred exemplary embodiment, consists of a brightly colored substantially watertight container filled with one or more freely-movable solid spherical objects. Spheres are preferred, although any object with a non-resilient surface capable of generating noise may be used. Movements of the container, preferably by vigorous hand-held shaking, cause the spheres to collide and impact with the inner wall of the container and with each other to produce an audible rattling sound. The rattling sound produced has a characteristic pitch, timbre and intensity which is easily transmitted through water and which is distinguishable from the rest of the audible undersea environment. In the preferred exemplary embodiment, the device is constructed of a section of polyvinyl chloride pipe, sealed at each end with end caps secured with a plumber's sealer or adhesive. In the preferred exemplary embodiment, a plurality of solid ball-bearings are contained in the container to produce a signaling sound with relatively high intensity. The device is preferably carried on a portion of the diver's diving apparatus with a standard rubber snorkel strap.

DESCRIPTION OF THE PREFERRED EMBODIMENT

Figure 1:
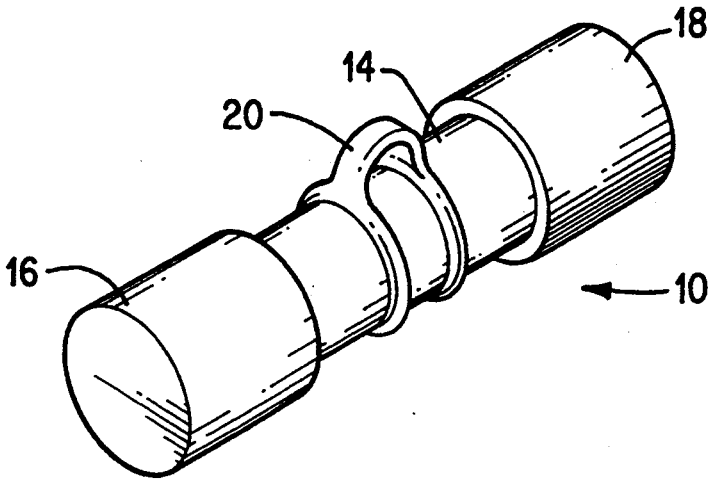
FIG. 1 is a perspective view of the preferred exemplary embodiment of the signaling device of the present invention.
Figure 2:
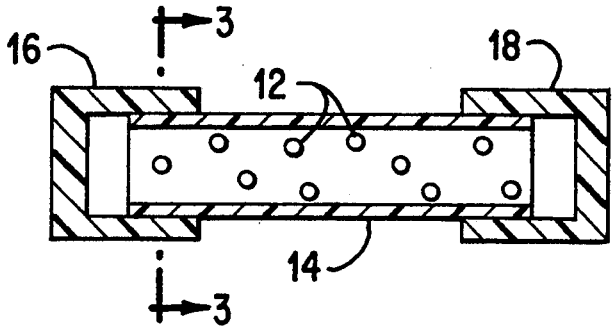
FIG. 2 is a cross-sectional side view of the invention shown in FIG. 1, showing the contained noise-generating ball-bearings.

As shown in FIG. 1 and 2, the preferred exemplary embodiment of the present invention consists of container 10 containing at least one and preferably more than one noise-generating sphere 12. Container 10 is preferably constructed of polyvinyl chloride (PVC) pipe material along its center section 14. The center section 14 has a length, in the preferred exemplary embodiment, of 4 9/16 inches and a diameter of 1 inch. The PVC material is a common, inexpensive, lightweight, rugged material which, when impacted by particles 12, produces a characteristic rattling sound easily distinguishable above other undersea sounds present in the diving environment. Container 10 can, of course, be constructed of other suitable materials.

Figure 3:
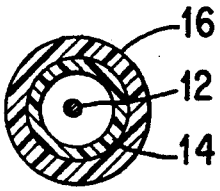
FIG. 3 is a cross-sectional end view taken along section 3—3 of FIG. 2, showing the respective diameters of the end caps and the center section of the device.
Figure 4:
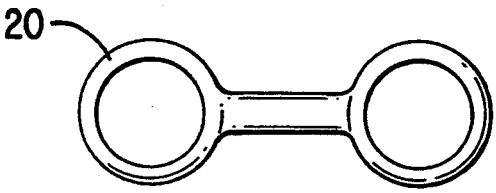
FIG. 4 is a plan view of the connecting strap of the preferred exemplary embodiment of the present invention.

Center section 14 is sealed at either end with end caps 16, 18 which are also preferably constructed of PVC material, and as shown in FIG. 3, have slightly larger diameters than center section 14, in order to snugly fit over the ends of center section 14. In the preferred exemplary embodiment, the diameter of end caps 16, 18 is 1 ¼ inches. End caps 16, 18 are preferably secured to the ends of center section 14 with standard plumbing sealer, or other suitable waterproof adhesive or sealant, to provide a watertight container which contains only air and spheres 12. The container need not be watertight, however, since the characteristic rattling sound may still be produced by ball bearings surrounded by water. With the trapped air inside, the device is buoyant in water, which beneficially lessens the weight imposed upon the diver. The entire length of container 10 with end caps 16, 18 is, in the preferred embodiment, 6 inches, in order to facilitate a hand-held shaking motion. The device is brightly colored, preferably a fluorescent orange, to facilitate visual signaling.

Spheres 12, in the preferred exemplary embodiment, consist of solid metallic ball bearings each having a diameter of ⅜ of an inch. A container containing only one sphere can produce the characteristic desired rattling sound, but a container having a plurality of freely-moving sphere, as in the preferred exemplary embodiment, tends to reinforce and increase the intensity of sound generated, increasing the signaling transmission range capability. Ten ball bearings 12 are utilized in the preferred exemplary embodiment. However, any number which would allow objects 12 to move freely without unduly increasing the weight of the device would be satisfactory.

Container 10 may be hand-held at all times, but it is preferable to secure the device to the diver's belt or diving equipment (not shown). For this purpose, strap 20 is shown in FIG. 1 and FIG. 5 for securing device 10 to the diver's diving equipment. In the preferred exemplary embodiment, strap 20 consists of a standard rubber snorkel holder, having holes in either end. Strap 20 is preferably looped around a piece of diving equipment such as the diver's console, and then secured to container 10 by stretching rubber material surrounding the holes in both ends of strap 20 over the enlarged end caps 16, 18, to fit snugly over the center section 14 of said container. This arrangement adheres container 10 to the console so that it is available for use when needed.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims.

What is claimed is:

1. A hand held underwater signaling device for use by human skin divers comprising:

an enclosed container; and one or more non-resilient objects contained within said container, wherein each said object is loosely-packed in said container such that vigorous manual displacement by the diver of said container will cause each said object to independently move and impact with an inner surface of said container causing audible sound vibrations to emanate therefrom.

2. A signaling device as in claim 1, wherein said container contains air and is watertight.

3. A signaling device as in claim 1, wherein said container has a cylindrical shape.

4. A signaling device as in claim 3, wherein a center section of said container consists of a pipe section constructed of polyvinyl chloride.

5. A signaling device as in claim 4, further comprising end caps secured to either end of said pipe section, wherein said caps are secured with an adhesive to provide a watertight seal.

6. A signaling device as in claim 1, wherein said container is brightly colored.

7. A signaling device as in claim 1, wherein said container contains a plurality of said non-resilient objects such that vigorous displacement of said container causes each said particle to move and impact each other as well as said inner surface of said container to produce said audible sound vibrations.

8. A signaling device as in claim 1, wherein each said non-resilient object comprises a ball bearing.

9. A signaling device as in claim 1, wherein said signaling device is used by a human skin diver having diving equipment including a weightbelt, said signaling device further comprising a securing means for securing said container to said diving equipment.

10. A signaling device as in claim 9, wherein said securing means comprises a resilient strap wrapped about a portion of said diving equipment and having ends secured to said container.

11. A signaling device as in claim 10, wherein said strap is constructed of rubber.

12. A hand held underwater signaling device mountable to diving equipment for use by a human skin diver, comprising:

a sealed, watertight container containing air; and one or more freely-moving non-resilient objects contained within said container which impact and collide with an inner surface of said container whenever said container is vigorously displaced manually by the diver, causing audible sound vibration to emanate therefrom.

13. A signaling device as in claim 12, further comprising end caps sealingly secured to either end of said container with adhesive, wherein said end caps and said container are both constructed of polyvinyl chloride pipe material.

14. A signaling device as in claim 12, wherein said container is brightly colored.

15. A signaling device as in claim 12, wherein each said non-resilient object comprises a ball bearing.

16. A signaling device as in claim 12, wherein said container contains more than one said non-resilient object such that vigorous displacement of said container causes each said particle to collide with each other as well as said inner surface of said container to produce said audible vibrations.

17. A hand held underwater signaling device mountable to a skin diving apparatus for manual use by a human skin diver, comprising:

a cylindrical section constructed of polyvinyl chloride;

end caps constructed of polyvinyl chloride secured to either end of said cylindrical section with a sealant, said cylindrical section and said end caps forming a sealed, watertight container; and a plurality of freely moving solid spheres enclosed within said container which collide both with each other and with an inner surface of said container to produce audible sound energy whenever said container is forcefully displaced manually by the skin diver.

18. A signaling device as in claim 17, wherein said watertight container contains only air and said spheres, wherein said spheres comprise ball bearings.

19. A signaling device as in claim 17, wherein said container is brightly colored.

20. A signaling device as in claim 17, further comprising a strap connecting said container and said skin diving apparatus, wherein said skin diving apparatus includes a weight belt.

* * * * *